US008733682B2

(12) United States Patent
Schiffer

(10) Patent No.: US 8,733,682 B2
(45) Date of Patent: May 27, 2014

(54) SHREDDING DEVICE

(75) Inventor: Peter Schiffer, Millstatt (AT)

(73) Assignee: Lindner-Recyclingtech GmbH, Spittal/Drau (AT)

( * ) Notice: Subject to any disclaimer, the term of this patent is extended or adjusted under 35 U.S.C. 154(b) by 299 days.

(21) Appl. No.: 13/201,617

(22) PCT Filed: Oct. 13, 2009

(86) PCT No.: PCT/EP2009/007358

§ 371 (c)(1), (2), (4) Date: Oct. 7, 2011

(87) PCT Pub. No.: WO2010/094306

PCT Pub. Date: Aug. 26, 2010

(65) Prior Publication Data

US 2012/0018555 A1 Jan. 26, 2012

(30) Foreign Application Priority Data

Feb. 17, 2009 (EP) ..... 09002196

(51) Int. Cl.
*B02C 18/22* (2006.01)

(52) U.S. Cl.
USPC ..... 241/224; 241/243

(58) Field of Classification Search
USPC ..... 241/222, 224, 225, 243, 242
See application file for complete search history.

(56) References Cited

U.S. PATENT DOCUMENTS

| | | | | |
|---|---|---|---|---|
| 4,127,236 | A | 11/1978 | Lasar | |
| 5,379,955 | A * | 1/1995 | McGraw | 241/186.2 |
| 5,417,374 | A * | 5/1995 | Kranz et al. | 241/18 |
| 7,926,753 | B2 * | 4/2011 | Carver | 241/99 |

FOREIGN PATENT DOCUMENTS

| | | | |
|---|---|---|---|
| DE | 4011670 | A1 | 10/1990 |
| DE | 9104544 | U1 | 6/1991 |
| DE | G9104544.4 | U1 | 6/1991 |
| JP | 08290075 | A | 11/1996 |
| WO | 2004071667 | A | 8/2004 |

* cited by examiner

*Primary Examiner* — Mark Rosenbaum
(74) *Attorney, Agent, or Firm* — IP Strategies

(57) ABSTRACT

The present invention relates to a shredding device for shredding material, comprising a material charging compartment in which the material to be shredded can be loaded; a rotor; and a pusher device having a pusher and a drive device for the pusher, wherein the pusher is pivotable about an axis such that it presses the material to be shredded towards the rotor, and wherein the pusher remains completely within the material charging compartment during operation.

13 Claims, 2 Drawing Sheets

SHREDDING DEVICE

FIELD OF THE INVENTION

The present invention relates to a shredding device for shredding material, particularly in the form of waste products and in particular a shredding device with a pusher device.

BACKGROUND OF THE INVENTION

Commercial, industrial, and household waste, e.g. (rigid) plastics, textiles, composites, rubber and used wood (such as pallets and chipboard), needs to be reduced in size before its final disposal or in particular before return to the recycling system. For shredding single or multi-shaft shredding machines are known, which for example are charged by wheel loaders, fork-lift trucks or conveyor belts via a hopper for charging material.

A central element of a conventional shredding machine is a rotor unit, which comprises a rotor which is fitted with tearing hooks or blades, which, for example, can be provided with concavely ground round cutter crowns. The blades are mounted for example by screwing onto blade bearers which are welded into or bolted onto blade pockets milled into the rotor. The shredding of the charged material occurs between the blades turned by the rotor and stationary, i.e. non-rotating, counter-blades (stator blades, scraper combs).

The charged material can, for example, be pressed in the direction of the rotating rotor by, for example, a pusher device controlled dependent on the load. After shredding between the rotating blades and the counter-blades, the material is output through a sieve device which determines the reduction factor according to the specification of the sieve size and conveys the material further with the aid of a conveyor belt, conveying screw, chain conveyor or suction system.

In particular with waste products of lower specific density or also with waste products too large to be conveyed, pressing of the material to be shredded towards the rotor is essential for shredding or at least necessary for commercial efficiency with regard to the throughput rate.

In the state of the art (DE 40 26 795 C3) a draw-type pusher (slide) for a scrap-wood shredding machine is known which comprises a press stamp which in turn has a press platen which presses the scrap wood towards the rotor horizontally or at a finite angle to the horizontal of the overall structure. A draw-type pusher of this nature is built into the shredding device supported on guides. These guides however inevitably become soiled in the course of the shredding operation and this can interfere with proper shredding operation. In addition the draw-type pusher increases the space required by the shredding device.

In an alternative embodiment the pusher device is installed pivotable and not completely integrated in the charging and shredding space of the shredding device, but rather has a press platen which is passed through an aperture in the hopper wall and which is movable parallel to the rotor (refer to AT 402 804 B). Also with this embodiment the space requirement is disadvantageously relatively high. In addition the sealing of the compression element passed through the aperture is problematical, because even if the press platen is pivoted without guidance for compression, waste products can gain access to the edges of the aperture, thus severely hindering the pushing process.

Thus, with regard to the problems mentioned an objective of the present invention is to make an improved shredding device with a pusher device available which requires the least possible space, and the reliability and operational efficiency of which is not or at least to a slighter extent impaired than as known in the state of the art through the impairment of the pushing process due to waste products to be shredded.

BRIEF SUMMARY OF THE INVENTION

As described above, pusher devices can be differentiated into those in which a draw-type pusher executes a linear pushing movement and those in which the material to be shredded is moved to the rotor by a pivoting movement. The present invention relates to an improved pusher device with a pusher of the pivoting type.

The above object is solved by a shredding device according to claim 1, i.e. a shredding device for shredding material, which comprises:

a material charging compartment into which the material to be shredded is loaded;

a rotor; and a pusher device with a pusher and a drive device for the pusher, whereby the pusher is pivotable about a shaft such that it presses the material to be shredded towards the rotor, and whereby the pusher remains completely within the material charging compartment during operation (i.e. when, particularly during the shredding of the material, it is driven by the drive device of the pusher device).

This shredding device thus comprises a pusher device, the pusher of which is fully installed in the material charging compartment of the shredding device. This particularly means that the pusher, which is in direct contact with the material to be pressed towards the rotor via a pusher surface during the pivoting movement towards the rotor, is not pivoted or otherwise guided towards the outside of the material charging compartment of the shredding device, but rather during shredding operation remains completely within this material charging compartment (of the hopper space), thus facilitating an essentially enclosed construction of the shredding device without disturbance due to waste products to be shredded, say on guide rails or at sealing points of housing apertures.

It is self-evident that the material charging compartment represents at least partially the interior space of the shredding device defined by walls, in which the material to be shredded is introduced and within which the pusher presses this material towards the rotor. This internal space may be a compartment which can or is enlarged by structures of any type, for example hopper-shaped structures for charging material. In particular the material charging compartment is differentiated from the outer space of a shredding device into which a pusher of the state of the art, as described in AT 402 804 B, pivots out of the shredding device in order to press the material towards the rotor in an oppositely directed pivoting movement.

The rotational direction of the pivoting movement of the pusher is advantageously opposite to the rotational direction of the rotor in order to ensure a particularly efficient pressing of the material to be shredded on the rotor fitted with blades or tearing hooks.

The shredding device can generally comprise a charging aperture for charging the material as well as an output aperture, which is provided with a sieve device for the output of the shredded material, and furthermore a first conveying device for conveying a material flow to be processed into the material charging compartment can be included before the shredding device and a second conveying device, which is provided for conveying the material components output from the shredding device, can be included after the shredding device. The material to be shredded may in particular be wood, plastic or textile waste products or other industrial, agricultural and household waste.

The drive device of the pusher device can in particular comprise a drivable shaft, which can in part extend inside the material charging compartment and on which the pusher is completely mounted within the material charging compartment. The drivable shaft of the pusher device can for example be rotationally supported in one or two walls, which partially define the material charging compartment, whereby according to one embodiment the shaft in particular does not extend into the material charging compartment and thus represents no obstacle to the charged material to be shredded.

The drivable shaft can be arranged parallel to the rotor axis. Rotation of the drivable shaft thus leads to a pivoting movement of the pusher in a certain angular range (refer also to the following description of FIG. 1 below).

According to one embodiment the pusher comprises side cheeks, which are joined to the pusher surface at one end and are joined on the other end to the drive device, in particular to a drivable shaft, whereby the intervening space between the side cheeks and the pusher surface remains free, so that the pusher device essentially causes no hindrance to the material to be shredded which is introduced into the material charging compartment (refer also to FIG. 2). The side cheeks and the pusher surface thus form an essentially U-shaped pusher device. In particular in this respect the pusher device can be arranged such that it executes the pivoting movement on one side of the rotor (referred to the longitudinal axis of the rotor), whereas the material to be shredded is fed from the other side of the rotor (referred to the longitudinal axis of the rotor).

For driving with a lifting mechanism the drivable shaft can be joined to the shredding device as part of the drive device outside of the material charging compartment. Since the lifting mechanism is mounted outside of the material charging compartment, it is not impaired by the material to be shredded which a corresponding linkage could impair or even partially block if it were installed within the material charging compartment.

According to a further development the shredding device according to the invention can furthermore and similarly comprise a hydraulic cylinder or a pneumatic cylinder outside of the material charging compartment, which is connected to the lifting mechanism and is arranged for driving the shaft via the lifting mechanism. Cylinders of this nature represent a reliable driving means which is relatively economical and easy to maintain or replace. Alternatively, at least one motorised drive, in particular a motor actuator or a torque motor, can be provided for driving the shaft.

The pusher surface of the pusher can be pivotable with the pusher in any operating state without contact to any walls defining, at least in part, the material charging compartment. In particular no guides (guide rails) are to be provided inside the material charging compartment (hopper space) of the shredding device, via which the pusher surface would be in contact with one of the walls along which the pusher would move and which would inevitably soil in operation, whereby the proper operation of the pusher device would be impaired. In contact with the material to be shredded, the pusher surface can therefore exert a force on the material, in particular without guidance.

According to an advantageous further development the force can be exerted via the pusher surface perpendicular or essentially perpendicular or at a small angle (about 10° to 20°) to the rotor axis and along the pivoting movement onto the material to be shredded. In an exemplary further development the pusher surface is not formed flat throughout, but rather has a concave or convex surface opposite the material to be pressed towards the rotor in order to efficiently press it towards the rotor. The term pusher surface here is generally used to designate a surface of the pusher which makes contact with the material during operation and which transfers the force onto this material corresponding to the torque of the driven shaft.

The shredding device according to the invention can furthermore be formed such that in a maintenance condition, which is different from any operating state of the pusher, the pusher can be at least partially pivoted out of the material charging compartment of the shredding device. Whereas in each operating state (that is during shredding of the material to be shredded) the pusher always remains completely installed in the material charging compartment of the shredding device (i.e. it remains completely within the material charging compartment for each pivoted state during shredding operation), it may be advantageous if for maintenance purposes the pusher is pivoted out of the material charging compartment, so that a maintenance person obtains easy access to it without having to betake himself into the shredding device.

In the maintenance state the pusher can be pivoted out of the material charging compartment such that the pusher surface in this maintenance state is located partially or completely outside the material charging compartment. Since it is subject to particular wear due to contact with the material to be shredded and the force transfer onto it due to the pivoting movement, easy access to this pusher surface can be obtained for maintenance purposes in this way.

BRIEF DESCRIPTION OF THE DRAWINGS

Further features and exemplary embodiments of the present invention are explained in more detail in the following based on the drawing. It is self-evident that the embodiments do not exhaust the scope of the present invention. It is furthermore self-evident that some or all of the features described below can be combined with one another in various ways.

DETAILED DESCRIPTION OF THE INVENTION

Figure 1:
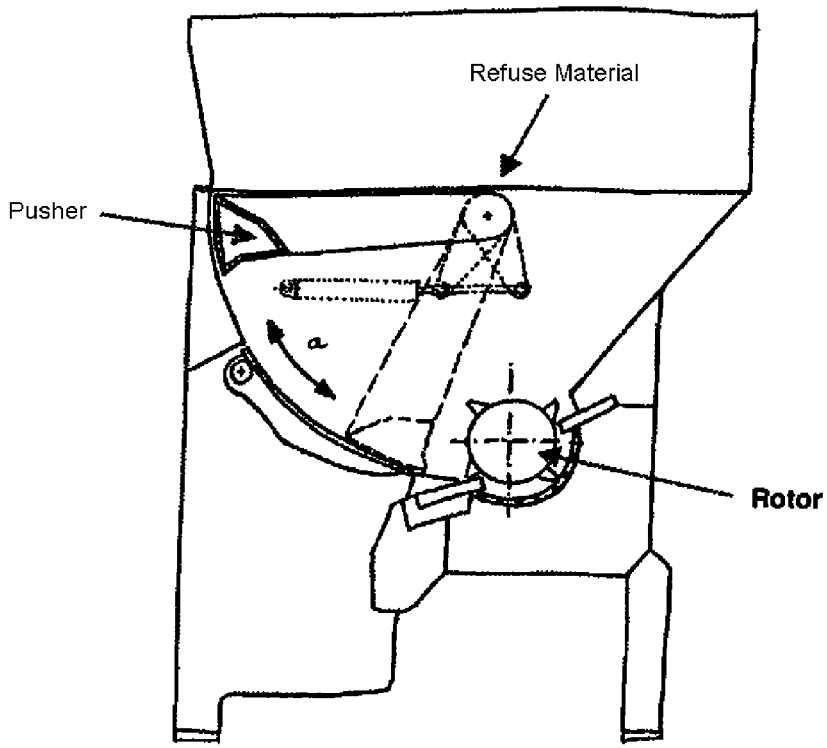
FIG. 1 illustrates an example of a shredding device according to the present invention, which comprises a pusher completely installed in the material charging compartment of the shredding device.

As illustrated in FIG. 1, in accordance with the present invention an exemplary vertical shredder comprises a rotor for shredding refuse material with blades interacting with stationary counter-blades, which are mounted on the shredder housing at both ends of the rotor. The shredded material is ejected through a sieve device fitted below the rotor and extending between the counter-blades.

In operation a pusher completely installed in the material charging compartment of the shredding machine pushes charged refuse material using pivoting movements against the rotating rotor. Two operating states of the pusher are illustrated in FIG. 1 by continuous or broken outlines of it. In the illustrated example the pusher has a pusher surface a formed concavely with respect to the material to be pressed in the direction towards the rotor.

The angular range between an operating state in which the pusher surface is located the furthest away from the rotor and an operating state in which it is located the closest is less than 90°, for example less than 80° or less than 70°. In each of these operating states of the shredding machine or of the pusher according to the invention the pusher remains completely in the material charging compartment of the shredding machine.

The pusher is driven by a shaft on which it is supported for the pivoting movement for pressing the material to be shredded. The shaft is for example joined to a lifting mechanism fitted outside of the material charging compartment, which is in turn driven by a hydraulic or pneumatic cylinder (refer to dotted outline in FIG. 1), or to similar systems which provide the torque on the shaft necessary for operation.

The material to be shredded is thus pressed by the pusher against the rotor where it is effectively shredded and finally output through the sieve device.

Figure 2:
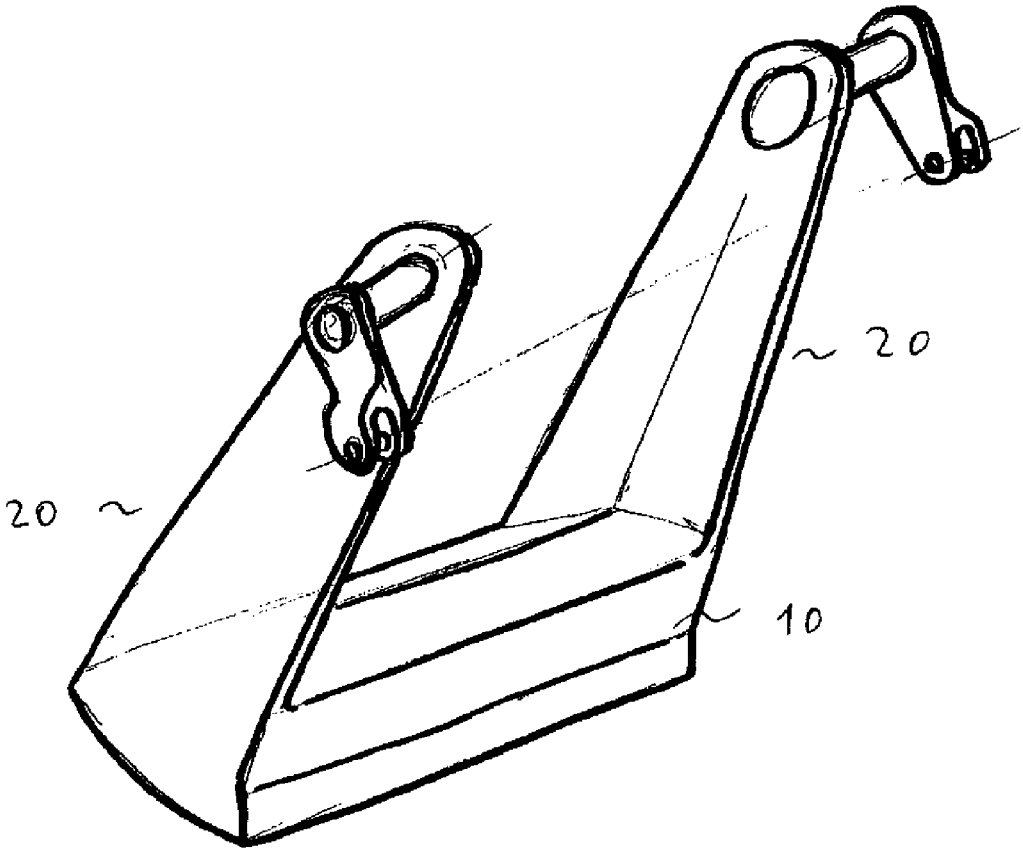
FIG. 2 illustrates an example of a pusher of a shredding device according to the present invention.

FIG. 2 illustrates a pusher of a shredding device according to the invention. The pusher has a pusher surface 10 and side cheeks 20. There is an intervening space between the pusher surface 10 and the side cheeks 20. A pusher device formed in this way essentially causes no hindrance to the material to be shredded which is introduced into the material charging compartment.

It is self-evident that the shredding device according to the invention includes both single and multi-shaft shredding machines and in particular vertical shredding machines. Similarly, the shredding device according to the invention includes single-shaft coarse shredding machines, which can preferably be used for the primary shredding of unsorted material.

Text Abb. 1

Nachdrücker=Pusher

Rotor=Rotor

Müll=Refuse

The invention claimed is:

1. A shredding device for shredding material, comprising:

a material charging compartment into which the material to be shredded is loaded;

a rotor; and a pusher device with a pusher and a drive device for the pusher, whereby the pusher is pivotable about a shaft such that it presses the material towards the rotor, and whereby the pusher remains completely within the material charging compartment during operation;

wherein the pusher device comprises side cheeks, which are joined to the pusher surface at one end and to the drivable shaft at the other end, wherein there is an intervening space between the side cheeks and the pusher surface, and wherein the pusher surface is formed flat throughout or has a concave surface opposite the material pressed toward the rotor.

2. The shredding device according to claim 1, in which the material charging compartment is delimited at least on one side by walls and the pusher comprises a pusher surface by means of which it presses the material to be shredded towards the rotor, and wherein the pusher can be pivoted without contact of the pusher surface to one of the walls of the material charging compartment.

3. The shredding device according to claim 1, in which the rotor comprises a rotor shaft, and the pusher surface in contact with the material exerts a force on the material without guidance essentially perpendicular to the rotor shaft.

4. The shredding device according to claim 1 in which the pusher surface is formed curved concavely or convexly.

5. The shredding device according to claim 1, in which the pusher is mounted on a drivable shaft completely within the material charging compartment.

6. The shredding device according to claim 5, in which the drivable shaft is arranged parallel to the rotor axis.

7. The shredding device according to claim 5, in which the drivable shaft is joined for driving to a lifting mechanism outside of the material charging compartment.

8. The shredding device according to claim 7 furthermore comprising a hydraulic cylinder or a pneumatic cylinder which is connected to the lifting mechanism and is arranged for driving the shaft via the lifting mechanism.

9. The shredding device according to claim 7 furthermore comprising at least one motorised drive, which is connected to the lifting mechanism and is arranged for driving the shaft via the lifting mechanism.

10. The shredding device according to claim 9, wherein the east one motorised drive is a motor actuator.

11. The shredding device according to claim 9, wherein the motorised drive is a torque motor.

12. The shredding device according to claim 1, in which in a maintenance state the pusher can be pivoted at least partially out of the material charging compartment of the shredding device.

13. The shredding device according to claim 12 in which the pusher can be pivoted out of the material charging compartment of the shredding device such that the pusher surface in this maintenance state is located outside the material charging compartment.

* * * * *